US005688037A

United States Patent [19]

Chen

[11] Patent Number: 5,688,037

[45] Date of Patent: Nov. 18, 1997

[54] BOOK LIGHT FOR SIMULTANEOUSLY OPENING THE SHADE AND ACTUATING THE SWITCH

[76] Inventor: Mike Chen, P.O. Box 55-1670, Taipei (10477), Taiwan

[21] Appl. No.: 600,072

[22] Filed: Feb. 12, 1996

[51] Int. Cl.[6] ..... F21V 33/00

[52] U.S. Cl. ..... 362/98; 362/186; 362/191; 362/199; 362/394; 362/396; 200/61.76

[58] Field of Search ..... 362/97, 98, 99, 362/155, 190, 191, 186, 199, 351, 352, 361, 394, 395, 396; 200/61.62, 61.76, 61.78

[56] References Cited

U.S. PATENT DOCUMENTS

| | | | |
|---|---|---|---|
| 3,694,644 | 9/1972 | Bauknight | 362/99 |
| 4,290,093 | 9/1981 | Thompson et al. | 362/98 |
| 4,432,042 | 2/1984 | Zeller | 362/99 |
| 4,598,340 | 7/1986 | Dwosh et al. | 362/98 |
| 5,442,528 | 8/1995 | Vandenbelt | 362/98 |

*Primary Examiner*—Alan Cariaso

[57] ABSTRACT

A book light includes: a shade having a lamp and an electrical control circuit fixed within the shade, a base for pivotally mounting the shade and the lamp on the base, a clamping device protruding forwardly from the base to be clamped on a book, and a push-button switch resiliently held in the shade normally protruding outwardly beyond the shade, whereby upon closing of the shade on the base, the push-button switch will be retracted into the shade to turn off the lamp as depressed by the base when pivotally folding the shade on the base; and upon opening of the shade from the base, the push-button switch will be automatically protruded outwardly to close the electrical control circuit to power and turn on the lamp for lighting use.

7 Claims, 6 Drawing Sheets

BOOK LIGHT FOR SIMULTANEOUSLY OPENING THE SHADE AND ACTUATING THE SWITCH

BACKGROUND OF THE INVENTION

U.S. Pat. No. 5,442,528 to Rudy A. Vandenbelt discloses a lighting device having a light-bearing neck of a bookmark retractable to fit within the body of the bookmark and extensible outwardly from the bookmark, causing the light to automatically energize above the pages of a book when reading.

However, this lighting device may have the following drawbacks:

1. When the lighting device is actuated for reading, the strip 2, 3 loaded with the lamp 4 thereon should be pulled outwardly to produce a bending moment especially when reading on a shaking car a ship, easily influencing electrical contacting between the batteries and the lamp to possibly interrupt the power supply to the lamp to occassionally turn off the lamp unexpectedly.

2. Frequent sliding movements as pulling out of the strip from the bookmark and retraction into the bookmark will easily cause loosening of the light-bearing neck on the bookmark.

3. The plurality of vertebraes 3 should be embedded and supported on an electrically conductive metal strip 8; while half vertebraes 28 should be provided in the base of the neck 2 to form the passive switch 17 for actuating the lamp 4, thereby increasing the production complexity, production cost and also maintenance problem.

The present inventor has found the drawbacks of the conventional lighting device insertable in or securable to a book, and invented the present book light which can be operated reliably.

SUMMARY OF THE INVENTION

The object of the present invention is to provide a book light including: a shade having a lamp and an electrical control circuit fixed within the shade, a base for pivotally mounting the shade and the lamp on the base, a clamping device protruding forwardly from the base to be clamped on a book, and a push-button switch resiliently held in the shade normally protruding outwardly beyond the shade, whereby upon closing of the shade on the base, the push-button switch will be retracted into the shade to turn off the lamp as depressed by the base when pivotally folding the shade on the base; and upon opening of the shade from the base, the push-button switch will be automatically protruded outwardly to close the electrical control circuit to power and turn on the lamp for lighting use.

DETAILED DESCRIPTION

Figure 1:
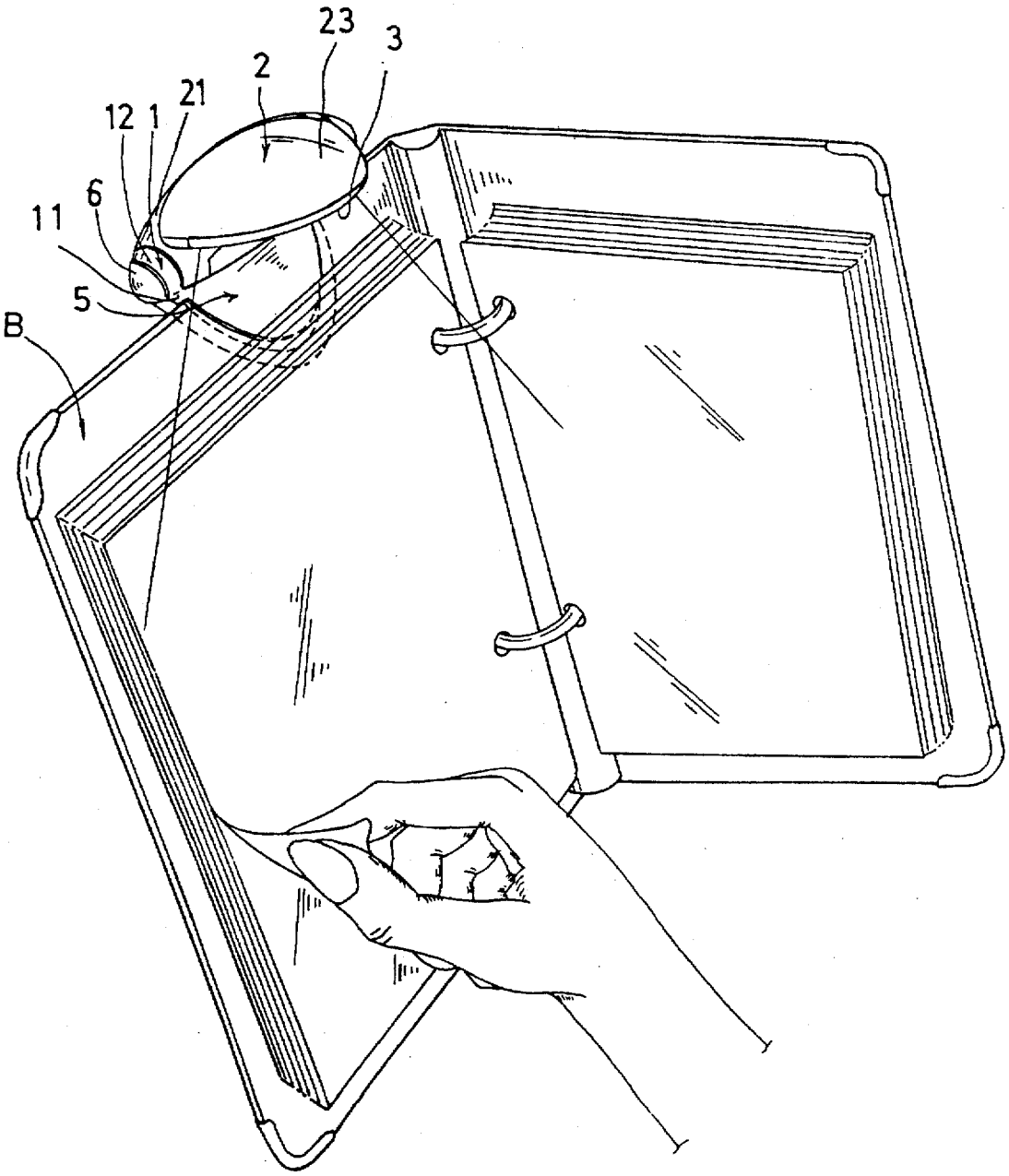
FIG. 1 is an illustration of the present invention when clamped on a book for lighting and reading purpose.
Figure 2:
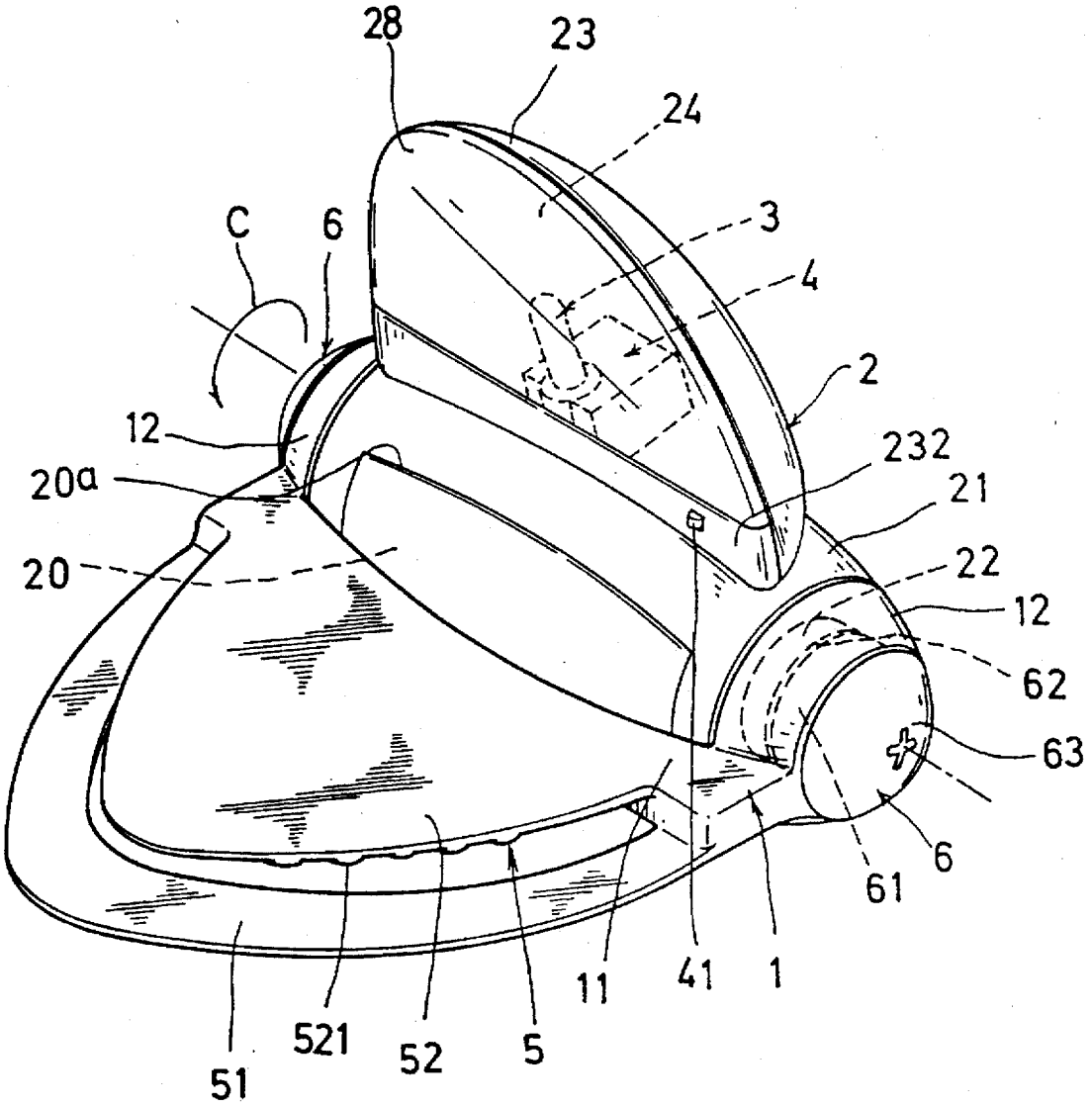
FIG. 2 is a perspective view of the present invention when opened.
Figure 3:
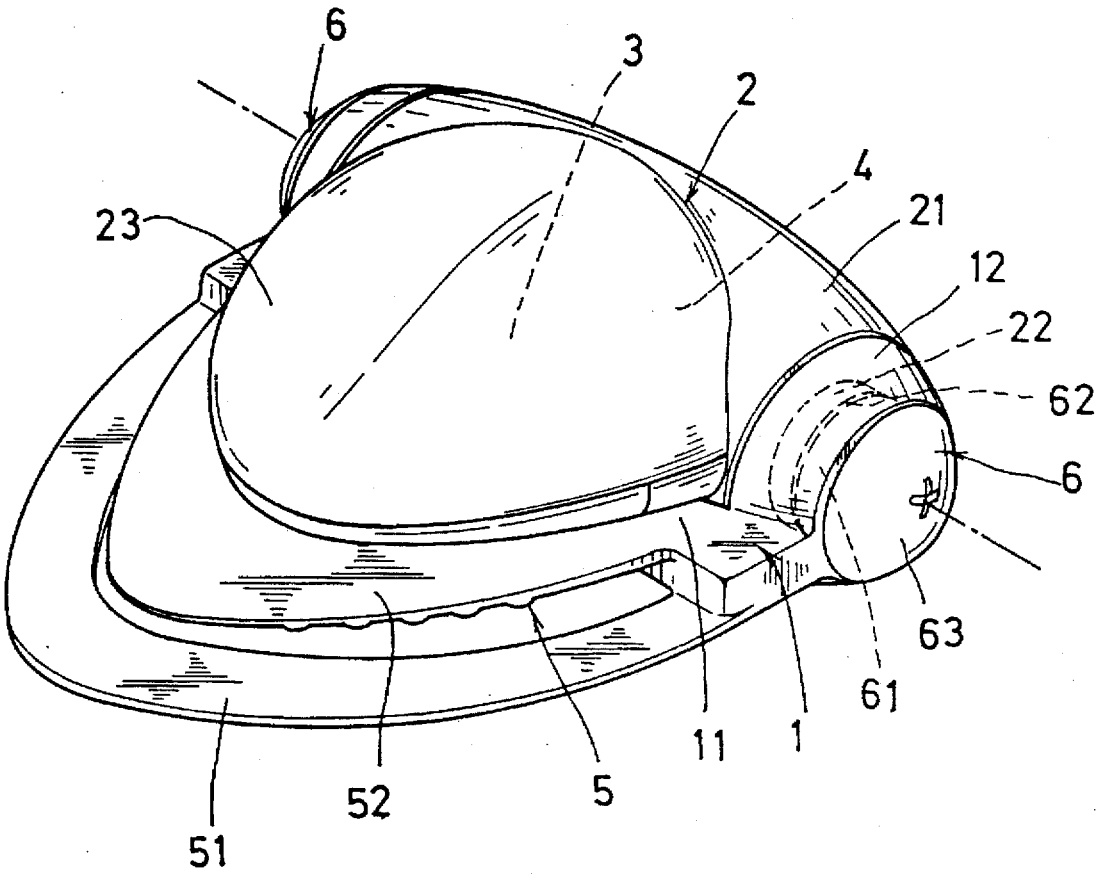
FIG. 3 is a perspective view of the present invention when closed.

As shown in the drawing figures, a preferred embodiment of a book light of the present invention comprises: a base 1, a shade means 2 pivotally mounted on the base 1, a lamp 3 secured in the shade means 2, an electrical control means 4 fixed in the shade means 2 for powering the lamp 3, and a clamping means 5 integrally formed with the base 1 to be clamped on a book B such as clamped on a book cover or pages or a notepad.

A pair of sealing plug 6 may be disposed on two opposite end portions of the base 1 for sealing a pair of pivot holes 13 formed in the base 1. The base 1 may also be formed with a closed pivot hole by eliminating the pair of sealing plugs 6.

Although the clamping means 5 is integrally formed on the base 1 as shown in the figures such as by plastic molding process. However, another clamping means 5 with spring loaded (not shown) may be modified to be attached to the base for resiliently clamping the book light on a book or a notepad by the spring provided on the clamping means 5, not limited in this invention.

The base 1 includes: a platform 11 having an upper flat surface formed on the platform 11, and a pair of bushings 12 bifurcated from the platform 11 to form a generally U shaped configuration, each bushing 12 formed with a pivot hole 13 in the bushing 12. A female-threaded portion 14 may be formed in an outer portion of the pivot hole 13 to be engaged with a male-threaded stem 61 of a sealing plug 6 for sealing each pivot hole 13. For simplifying the production, the female-threaded hole 14 in the pivot hole 13 and the male threads on the sealing plug 6 may also be omitted by inserting a cylindrical sealing plug 6 into the pivot hole 13 as shown in FIG. 4A.

The lamp 3 used in this invention may be a bulb or any other electric illuminators, not limited in this invention.

Figure 4:
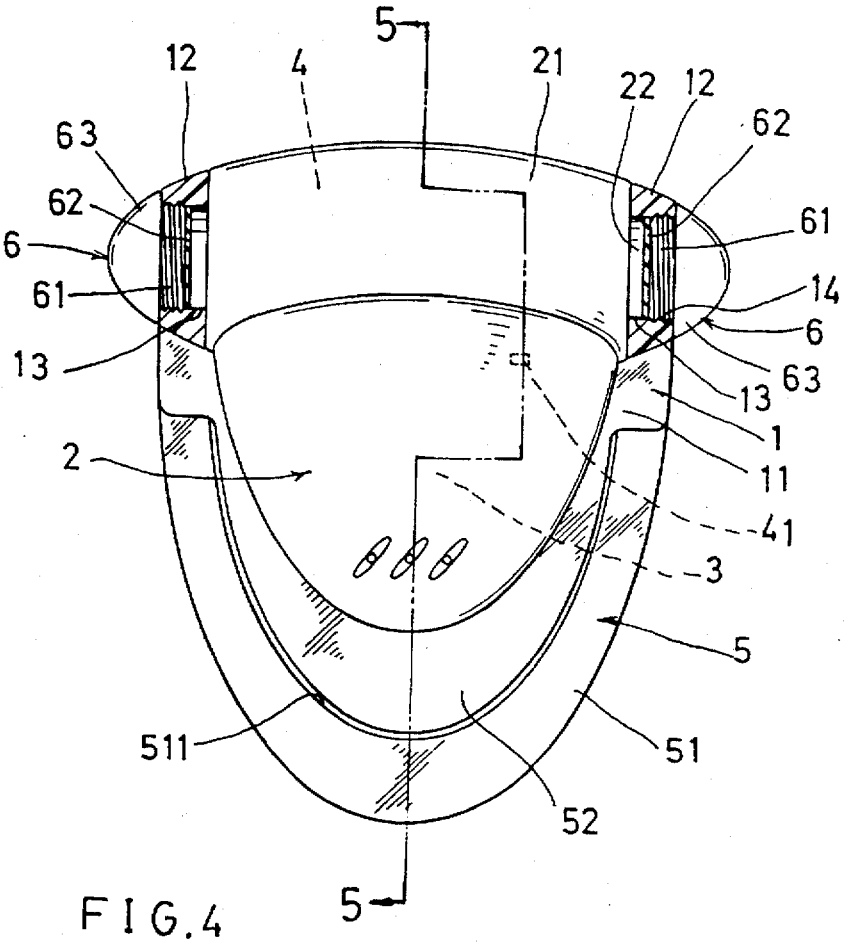
FIG. 4 is a top view of the present invention.
Figure 4A:
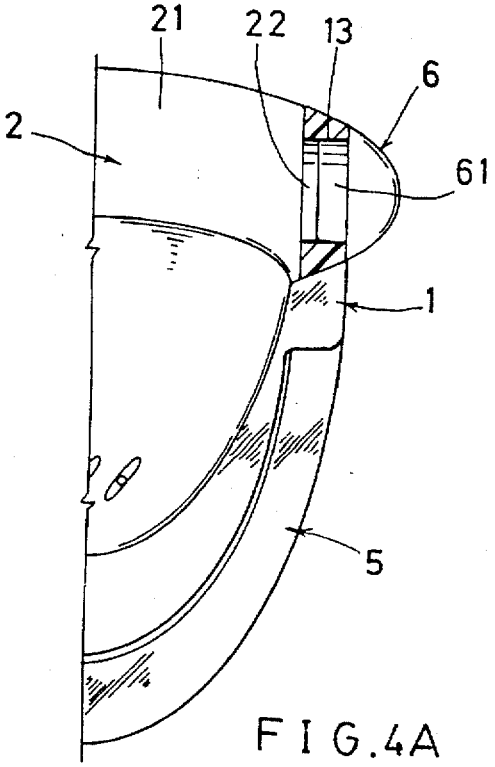
FIG. 4A shows another preferred embodiment of the pivot hole and sealing plug of the present invention.

The shade means 2 may be pivotally secured to the base 1 by the pivoting mechanism as shown in FIGS. 4, 4A, or by any other hinge devices, not limited in this invention.

The shade means 2 includes: a shaft portion 21 having a pair of pivots 22 disposed on two opposite ends of the shaft portion 21 each pivot 22 rotatably engageable with the pivot hole 13 formed in the bushing 12 of the base 1 for pivotally mounting the shade means 2 on the base 1, a shade portion 23 laterally protruded from the shaft portion 21 having a parabolic reflector 231 formed on a back portion of the shade portion 23 and a flat cover 232 formed on a surface portion of the shade portion 23 opposite to the parabolic reflector 231, and a lens 28 fixed in a lens opening formed in the flat cover 232 to define a lamp chamber 24 in between the lens 28 and the reflector 231 for securing the lamp 3 on a lamp holding protrusion 25 within the lamp chamber 24.

The shaft portion 21 is formed with a battery chamber 20 therein for fixing a power source 45 of a battery or plural batteries of the electrical control circuit 4 in the battery chamber 20, and a cover **20*a* formed in the shade means for covering the battery chamber 20** for re-filling of batteries.

The electrical control circuit 4 includes: a push-button switch 41 having a disk member 411 formed on a base portion of the switch 41 to be resiliently held on a restoring spring 412 retained in a spring socket 27 formed in the shade means 2 with the disk member 411 made of electrically conductive materials, a pair of contactors 42 separating with each other and respectively fixed on a pair of contactors stems 26 formed in the shade means 2 to contact the disk member 411 of the push-button switch 41 when resiliently urged outwardly by the restoring spring 412, a first and a second electric wire 43, 44 electrically connected between the lamp 3 and two poles of the power source 45 having the first electric wire 43 connected to one of the two poles of the power source 45 through the two contactors 42 which may be closed by the disk member 411 when the push-button switch 41 is urged outwardly by the restoring spring 412 to contact the disk member 411 with the two contactors 42; whereby upon depressing of the push-button switch 41 by closing (C) the shade portion 23 on the platform 11 of the base 1, the push-button switch 41 is retracted inwardly through a button hole formed in the flat cover 232 of the shade portion 23 to separate the two contactors 42 to disconnect the first wire 43 to interrupt a power supply to the lamp 3 for automatically turning off the lamp 3; and upon opening (0) of the shade portion 23 by pivoting the shaft portion 21 and the pair of pivots 22 about the pivot holes 13 in the base 1, the push-button switch 41 will be automatically protruded outwardly as urged by the restoring spring 412 to close the two contactors 42 to close the two wires 43, 44 to power and light up the lamp 3 by the power source 45.

Figure 5:
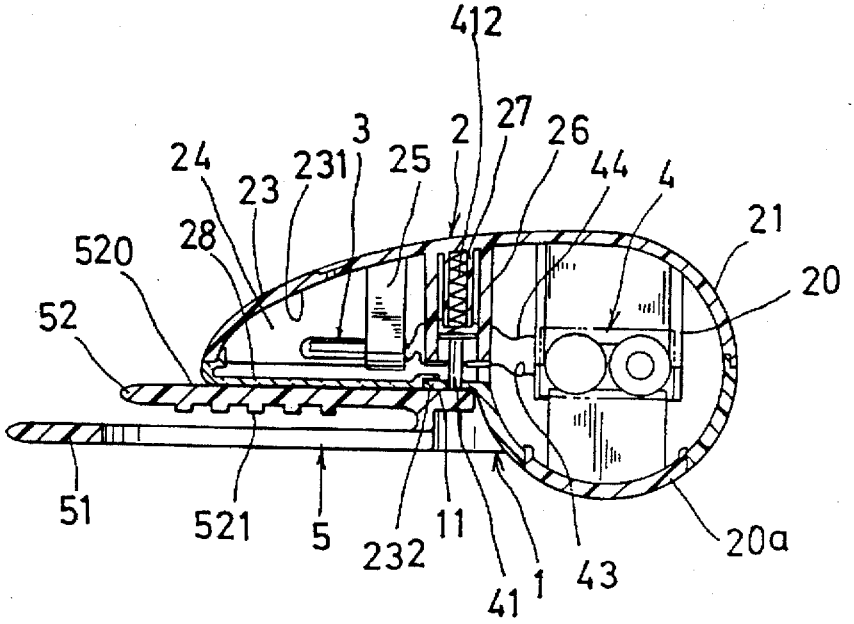
FIG. 5 is a longitudinal sectional drawing of the present invention as viewed from 5—5 direction of FIG. 4.
Figure 6:
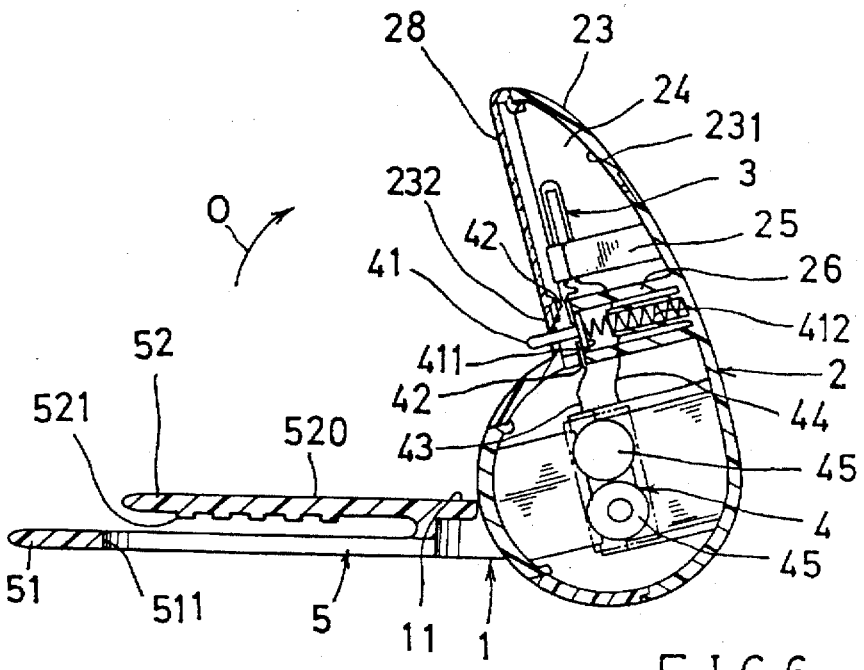
FIG. 6 is a longitudinal sectional drawing of the present invention when opened.
Figure 7:
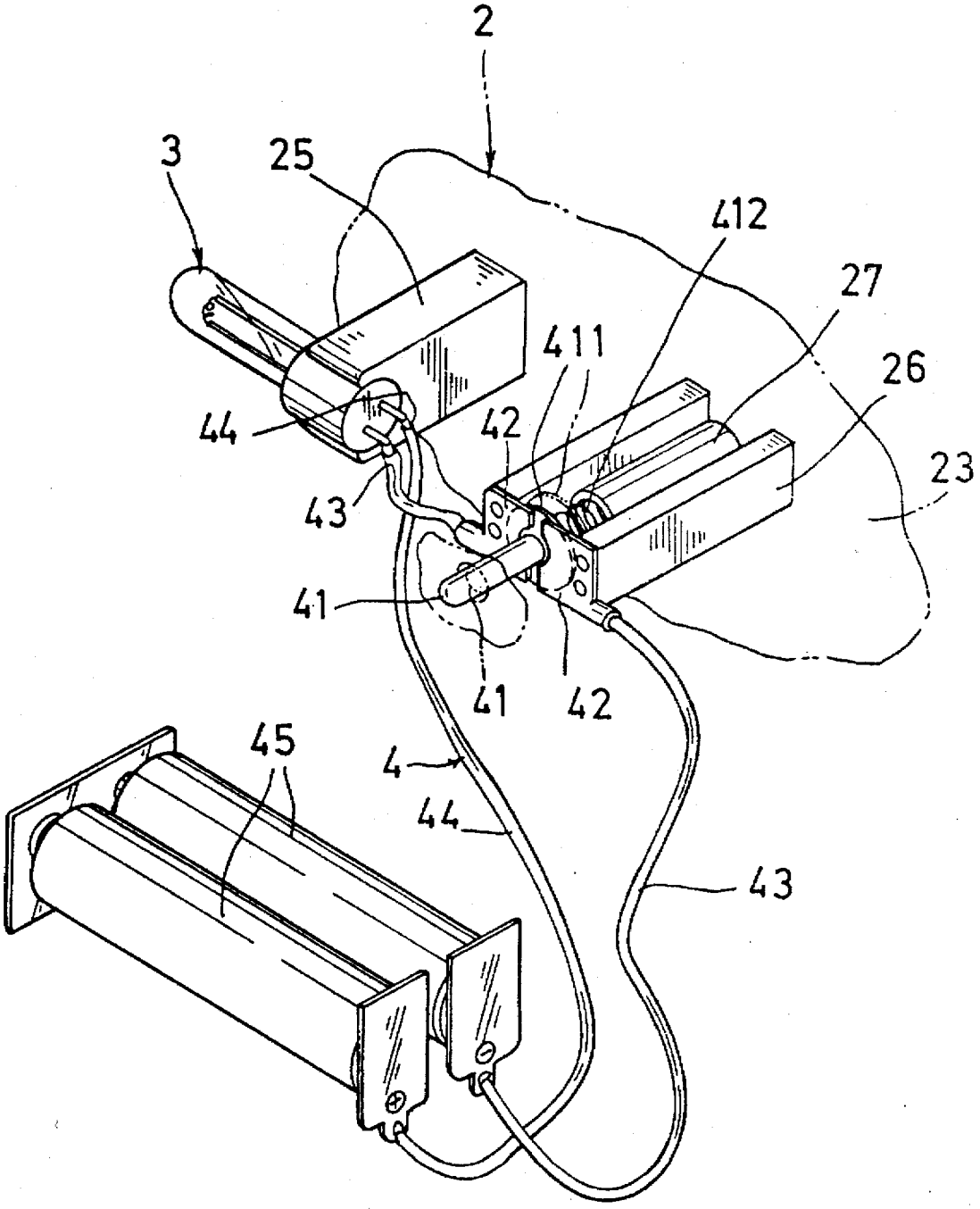
FIG. 7 is an illustration showing the electrical control circuit of the present invention.

The clamping means 5 includes: a first clamping arm member 51 and a second clamping arm member 52 bifurcated from the base 1 to be clippable on a book B, notepad or the like, with the second clamping arm member 52 positioned above the first clamping arm member 51 and having an upper flat surface 520 coplanar to an upper flat surface of the platform 11 of the base 1 for a close contact with the lens 28 and the flat cover 232 of the shade portion 21, with the flat cover 232 coplanar to an outer surface of the lens 28, when closing the shade portion 23 on the platform 11 for retracting and turning off the push-button switch 41 as shown in FIG. 5 for switching off the lamp 3 and also for protecting the lens 28 and the lamp 3 at a closed situation. The first arm member 51 may be cut out an opening 511 for saving material.

The second arm member 52 has a corrugated bottom surface 521 for frictionally holding a book when clamping the book in cooperation with the first arm member 51.

Each sealing plug 6 includes: a stem 61 protruding inwardly from a knob 63, and the knob 63 disposed at a side portion of the bushing 12 of the base 1, with the stem 61 inserted in the pivot hole 13 in the base 1.

The stem 61 may be coated with a frictional packing member 62 on an inner end of the stem 61 to be frictionally contacted with the pivot 22 of the shade means 2 for preventing loosening of the shade means 2 when rotatably mounted on the base 1. Naturally, the packing member 62 may be omitted as shown in FIG. 4A. The packing member 62 may also be substituted with a tensioning spring (not shown) retained between the pivot 22 and the plug 6.

The frictional holding between the pivot 22 of the shade means 2 with the plug 6 may prevent the loosening of the shade means 2 on the base 1. Also, a desired illuminating angle of the lamp 3 and the shade means 2 may be optionally adjusted by a frictional contact between the frictional packing member 62 and each pivot 61 of the sealing plug 6.

The present invention is superior to any conventional book light because of the following advantages:

1. When opening the shade means 2 from the base 1, the switch 41 and the lamp 3 will be automatically turned on; and when foldably closing the shade means 2 on the base 1, the lamp 3 will be automatically switched off for a convenient and automatic on-off control of the lamp 3.

2. The electrical circuit 4 is mounted in the shade means 2 and is uninfluenced by the pivotal movement of the shade means 2 about the bushings of the base 1, ensuring a nice electrical contacting between the electrical control circuit 4 and the lamp 3 for a reliable turning on or off of the lamp 3.

3. The structure and pivotal mechanism of the present invention is simple and cheap, helpful for production and maintenance convenience.

The present invention may be modified without departing from the spirit and scope as claimed in this invention.

I claim:

1. A book light comprising:

a base having a clamping means secured to said base to be clamped on a book;

a shade means pivotally secured on said base and having a lamp mounted in said shade means; and an electrical control circuit mounted in said shade means for powering the lamp, having a push-button switch resiliently held in said shade means and protruding outwardly beyond said shade means for closing the electrical control circuit;

said shade means foldably closed on said base to retract said push-button switch inwardly in said shade means to disconnect the electrical control circuit to turn off said lamp; whereby upon an outward pivotal movement of said shade means to unfold said shade means from said base, said push-button switch is protruded outwardly beyond said shade means to close said electrical control circuit to automatically turn on said lamp for reading use;

said base including: a platform secured with said clamping means and having an upper flat surface formed on the platform, and a pair of bushings bifurcated from the platform as generally U shaped, each said bushing formed with a pivot hole therein; and said shade means including: a shaft portion having a pair of pivots disposed on two opposite ends of the shaft portion each said pivot rotatably engageable with each said pivot hole formed in each said bushing of the base for pivotally mounting the shade means on the base, a shade portion laterally protruded from the shaft portion having a parabolic reflector formed on a back portion of the shade portion and a flat cover formed on a surface portion of the shade portion opposite to the parabolic reflector, and a lens fixed in the flat cover to define a lamp chamber in between the lens and the reflector for securing the lamp within the lamp chamber in said shade means.

2. A book light according to claim 1, wherein said shaft portion is formed with a battery chamber therein for fixing a power source of at least a battery of the electrical control circuit in the battery chamber, and a cover formed in said shade means for covering the batttery chamber.

3. A book light according to claim 1, wherein said electrical control circuit includes: said push-button switch having a disk member formed on a base portion of the switch to be resiliently held on a restoring spring retained in a spring socket formed in the shade means with the disk member made of electrically conductive materials, a pair of contactors separating with each other and respectively fixed on a pair of contactors stems formed in the shade means to contact the disk member of the push-button switch when resiliently urged outwardly by the restoring spring, a first and a second electric wire electrically connected between the lamp and two poles of the power source having the first electric wire connected to one of said two poles of the power source through the two contactors operatively closed by the disk member when the push-button switch is urged outwardly by the restoring spring to contact the disk member with the two contactors; whereby upon depressing of the push-button switch by closing the shade portion on the platform of the base, the push-button switch is retracted inwardly in the shade portion to separate the two contactors to break an electrical connection between one said wire, said power source and said lamp to interrupt a power supply to the lamp and to turn off the lamp.

4. A book light according to claim 1, wherein said clamping means includes: a first clamping arm member and a second clamping arm member bifurcated from the base to be clippable on a book, with the second clamping arm member positioned above the first clamping arm member and having an upper flat surface of said second arm member coplanar to an upper flat surface of the platform of the base for a close contact with the lens and the flat cover of the shade portion with said flat cover of said shade portion coplanar to an outer surface of the lens when closing the shade portion on the platform for turning off the push-button switch for switching off the lamp.

5. A book light according to claim 1, wherein each said pivot hole in said bushing is sealed with a sealing plug which includes a stem protruding inwardly from a knob of said plug into the pivot hole, and the knob of said plug disposed at an outer side portion of the bushing of the base, said stem inserted into said pivot hole for sealing said pivot hole.

6. A book light according to claim 5, wherein said stem of said plug is coated with a frictional packing member on an inner end of the stem to be frictionally contacted with the pivot of the shade means for preventing loosening of the shade means when rotatably mounted on the base.

7. A book light according to claim 5, wherein said pivot hole has a female-threaded portion formed in an outer portion of the pivot hole of the bushing of said base, and said stem of said plug is formed with male threads on said stem to be engageable with said female-threaded portion in said pivot hole for sealing said sealing plug in each said pivot hole.

* * * * *